US006152842A

United States Patent [19]

Licursi

[11] Patent Number: 6,152,842

[45] Date of Patent: Nov. 28, 2000

[54] HOCKEY PUCK FOR STREET AND COURT PLAY

[76] Inventor: Frank Licursi, 426 Cary Ave., Staten Island, N.Y. 10310

[21] Appl. No.: 09/012,655

[22] Filed: Jan. 23, 1998

Related U.S. Application Data

[60] Provisional application No. 60/036,686, Apr. 11, 1997.

[51] Int. Cl.[7] ..... A63B 71/00

[52] U.S. Cl. ..... 473/588

[58] Field of Search ..... 473/588

[56] References Cited

U.S. PATENT DOCUMENTS

| | | | |
|---|---|---|---|
| 5,149,096 | 9/1992 | Keating et al. | 473/588 |
| 5,346,214 | 9/1994 | Bruhm | 473/588 |
| 5,465,966 | 11/1995 | La Savio | 473/588 |
| 5,482,274 | 1/1996 | Bellehumeur | 473/588 |
| 5,597,161 | 1/1997 | Bellehumeur et al. | 473/588 |
| 5,695,420 | 12/1997 | Bellehumeur et al. | 473/588 |
| 5,697,858 | 12/1997 | Lekavich | 473/588 |

*Primary Examiner*—Raleigh W. Chiu
*Attorney, Agent, or Firm*—Goldstein & Canino

[57] ABSTRACT

A hockey puck designed for street and court play reduces frictional resistance between the peripheral puck edge and the play surface, substitutes more durable materials that better emulate puck motion on ice surfaces and emulates the physical properties of an ice hockey puck. The puck incorporates a plurality of runners, preferably fabricated from acetal plastic or other like material, and having a partial disk-shaped exposed surface. The runners are secured within a vulcanized rubber body with the properties of a traditional ice hockey puck, to preserve the authenticity and feel of ice hockey play when playing on non-ice surfaces. Runners engage the periphery of the top and bottom surfaces of the puck body. Symmetrical and equidistant placement of the individual runners better allows even puck maneuverability. The top and bottom sets of runners, are injection molded into the puck body to form one solid piece through the puck, and are also aligned to further balance the puck for dynamic equilibrium in play. Beveled edges of the puck body interface with the runners to ensure contact with the puck body and playing surface is minimized as the runners wear from use. The outermost, thickest and exposed sides of the runners are parallel to, but recessed slightly from the endless side of the puck body, which is knurled in traditional ice hockey fashion, ensuring unrestricted contact and optimal gripping ability between puck side and players' stickblades. An unexposed internal connecting member integrally connects corresponding sets of runners along top and bottom puck surfaces within the puck body.

5 Claims, 5 Drawing Sheets

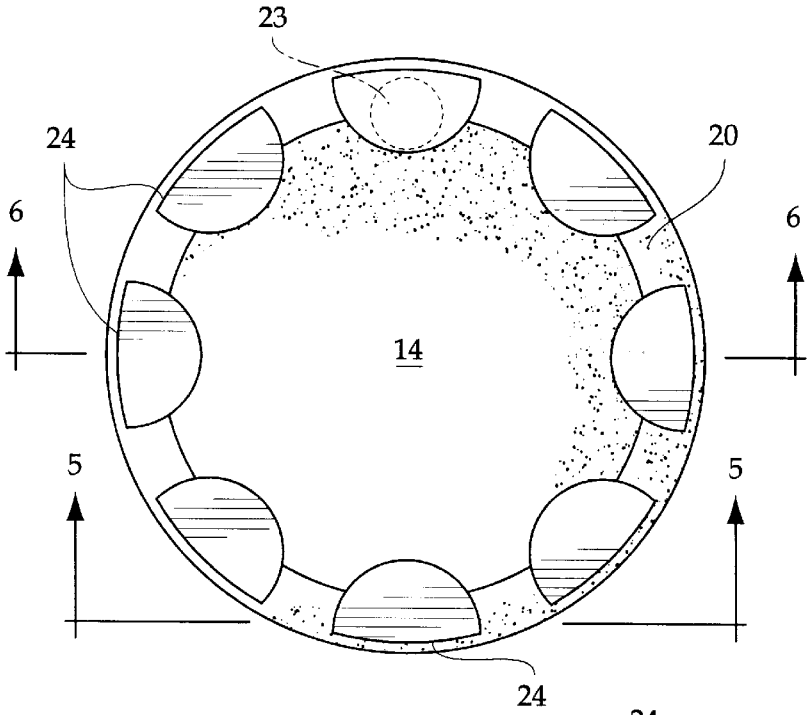
Fig. 4
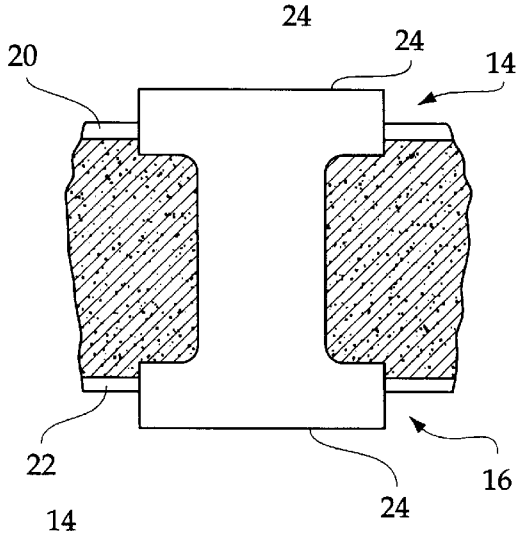
Fig. 5
Fig. 6
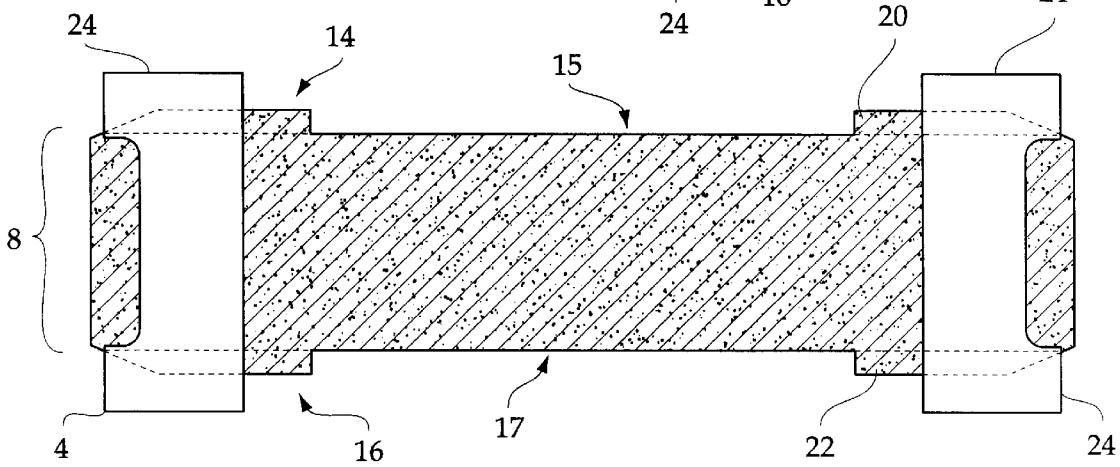

HOCKEY PUCK FOR STREET AND COURT PLAY

This application relates to subject matter contained in Provisional Patent Application Serial No. 60/036,686, filed on Apr. 11, 1997.

BACKGROUND OF THE INVENTION

1. Field of the Invention

The present invention relates to sports equipment, and more specifically, to hockey pucks designed for use on non-ice play surfaces.

2. Description of the Prior Art

A problem long recognized by street and court hockey players involves the non-ice playing surface, typically of asphalt, concrete, tennis court, Sport Court, coated hardtop, or wood construction. Many of these surfaces lack the smoothness of ice hockey playing surfaces, causing players to encounter more friction when moving a hockey puck across the area of play, and ultimately slowing the pace of the game. Many types of proposed surface alterations to the typical puck have aimed to alleviate this problem. Often these pucks designed for non-ice play, are fabricated from lighter, less durable materials than their ice hockey counterparts (plastic instead of rubber), resulting in a reduction in play quality, equipment authenticity, and in some cases, the need to frequently replace the puck to sustain play due to breakage. This substitution also causes players to lose the "feel" associated with the ice hockey puck. Existing street and court hockey pucks have other shortcomings as well.

The puck described in U.S. Pat. No. 5,366,219 comprises a hollow plastic shell and a plastic interior "spider" frame, having ground engaging projections, known as runners, that penetrate the shell on its top and bottom surfaces. While the runners elevate the puck body, preventing its contact with the playing surface, they cover little surface area relative to the overall size of the puck, causing them to wear quickly, and lacking stability on less than pristine playing surfaces. This eliminates its intended friction-reducing quality. As the runners wear from usage, the puck body makes contact with the playing surface.

Other street hockey pucks also feature a runner structure for improved maneuverability along non-ice playing surfaces. U.S. Pat. Nos. 5,184,820, 5,288,072 and 5,346,214 all, incorporate hemispherical surface articulations to aid puck performance. Unfortunately again, the shape and size of the runners on the hockey pucks of '820, '072, and '214 and their small surface area with respect to the size of the puck surface area, causes them to behave erratically on play surfaces that have irregularities. Even fairly smooth playing surfaces such as coated concrete, or tennis court surfaces are irregular enough to greatly reduce puck performance in a game known for fluidity and speed.

U.S. Pat. No. 5,482,274 describes another variation on the runner design. Rather than having runners that integrally connect the puck surface, '274 proposes runners having a head partially retained in a recess in the puck. Each recess acts as a support for its runner to reduce the chance of breakage. Stabilizing runners also project from both of the puck surfaces to prevent the puck from flipping over. Despite its specialized runner design, the invention of '274 utilizes runners that are rounded, small, and prone to catching in small cracks, holes, or other irregularities in various playing surfaces. In the cases of Patents '274 and '219, their performances are not only limited by surface conditions, but by climate conditions as well. The materials used in the construction of both inventions are prone to crack and break in cold weather, rendering them impractical for use outdoors in cold climates, many of which hockey is frequently played.

Perhaps the greatest shortcoming in the design of the above patents is the absence of any friction-reducing means (such as runners) on the peripheral edges of the top and bottom puck surfaces. The runners of Patents '274, and '219 are only effective at reducing friction when the puck is lying flat, and the puck runners are in contact with the playing surface. During play however, the occurrence of the puck being propelled from a flat position to a position where either peripheral edge makes contact with the playing surface, is frequent and inevitable over the course of a game. This condition is common even in ice hockey, where friction is greatly less, relative to the puck-to-playing surface condition of non-ice play. The low friction interaction between puck edge and ice is what enables players to maintain its control from the flat position, or on edge, upwards of angles approaching 90 degrees from horizontal. In the case of roller hockey pucks where there are no runners, or other means, to reduce friction at either of the two edges where it is greatly needed, the resultant behavior is unfavorable for puck handling, in the form of hopping and bouncing. This unpredictable condition greatly diminishes game quality on the whole, as well as the talents and skills of individual players.

Furthermore, many existing pucks for street and court hockey, which are constructed from plastic, are uncharacteristically lightweight. The pucks of U.S. Pat. Nos. 5,482,274 and 5,366,219 weigh approximately 3 ounces, and lack the density, center of gravity, and "feel" of an ice hockey puck which is made of vulcanized rubber, weighing approximately 6 ounces, and having a hardness of approximately 80 Durometer. Lightweight pucks make it difficult to handle by feel, causing the puck handler to have to look to the ground with more frequency to maintain its control.

The pucks described in U.S. Pat. Nos. 5,346,214 and 5,482,274 have runners made of nylon, which in conjunction with small surface area, tend to wear quickly. Other materials have more favorable properties, and would wear less and endure longer than nylon in this capacity. None of the above inventions and Patents, taken either singly or in combination, is seen to describe the instant invention as claimed.

SUMMARY OF THE INVENTION

The street and court hockey puck of the present invention is designed to improve the quality of play by better emulating the feel and performance of an ice hockey puck on non-ice surfaces. Firstly, by constructing the puck from vulcanized rubber, to maintain the authenticity and feel of a true ice hockey puck. Secondly, by utilizing runners, which are uniquely shaped to better replicate the behavioral characteristics of a puck on ice. This is done by shaping the runners to conform to the peripheral puck edges of both top and bottom planes, reducing frictional resistance between them and the playing surface. This is also achieved by utilizing more durable materials, most specifically acetal, which has a high level of lubricity, and interacts well as a friction-reducing means with most common off-ice hockey surfaces.

Puck-to-play surface contact at the peripheral puck edge can adversely affect puck performance, and limit game quality, if no means of ensuring smooth handling exist. The hockey puck of the present invention incorporates a plurality of runners fabricated from acetal plastic, and having a partial disk shaped exposed surface. The exposed surface of the runner assembly, that makes contact with the play surface, is flat and displaces much more area than the hemispherical runners of other roller hockey pucks. These runners are more capable of negotiating the irregularities, cracks, and textures of various surfaces. Because of their large size, they are less prone to catching than a smaller runner with a rounded head. The runners are injection molded directly into the puck body. The result is a runner system with added strength and resistance to breakage. The puck body made from vulcanized rubber, is made from the same material as a traditional ice hockey puck (a natural rubber compound known as SBR), with the same hardness (Durometer of about 80), and same diameter of a regulation puck (3 inches).

The rubber body also has a knurled edge as a regulation ice hockey puck does, to further maintain the properties, feel, and authenticity of ice hockey. The top and bottom surfaces of the rubber body each have a 1.5 inch diameter recess at center that is 0.15 inches deep. The recess is deliberately placed to give the puck more flexibility at its center which aids puck compression, giving players more velocity on slapshots, much the same as a golf ball does when struck off a tee. The recessed center also provides a dampening effect for the puck runners upon impact with a goalpost, rinkboards, or other immutable objects present about the area of play. The dampening feature further reduces the chance of runner breakage during play. Two rings of individual runners engage the periphery of the top and bottom surfaces of the puck body. Symmetrical and equidistant placement of the individual runners better allows even puck maneuverability. The top and bottom sets of runners are also aligned to further balance the puck for dynamic equilibrium in play.

Further structural features of the present invention include beveled edges along the perimeter of the puck body. The beveled edge ensures minimal contact between the puck body and playing surface as the runners wear. The outermost, thickest, exposed sides of the runners are recessed slightly (about $1/16^{th}$ inch) from the side of the puck body. Recessing the runners enables the rubber side, with its knurled surface, unrestricted contact with the player's stickblade during play. Its superior gripping capability enables players to handle passes at high velocities which "deaden" on their sticks, gives them more shot control, and better rotation on wrist, snap, and backhand shots, where tight puck rotation is crucial. The weight of the present invention is approximately 4 ounces. A typical plastic street hockey puck weighs about 3 ounces, a regulation ice hockey puck about 6 ounces. The weight of the present invention was chosen to most closely replicate the "feel" a player would get in his hands from handling a 6 ounce puck on ice. A lighter puck is necessary to compensate for the increase in play surface friction when going from ice, to asphalt, for example. While typical plastic pucks are also lighter than an ice hockey puck, they lack the density of rubber, and the center of gravity ice players are accustomed to.

Accordingly, it is a principal object of the invention to provide a hockey puck for street and court play with which players can better negotiate surface irregularities without compromising game quality.

It is another object of the invention to more accurately simulate ice hockey play by maintaining the physical properties of an ice hockey puck as well as introducing the responsiveness and feel of a puck on ice to non-ice hockey play surfaces.

Still another object of he invention is to ensure continuous, co-operative contact between the runners and the surface of play at horizontal as well as on the peripheral puck edge, while enhancing controllability and feel through unobstructed contact between the puck side, and players' stickblades.

It is also an object of the invention to incorporate materials that decrease wear and friction, with superior impact capacities, and hence, prolong the life of the puck.

It is also an object of the invention to provide improved elements and arrangements thereof in an apparatus for the purposes described which is inexpensive, dependable, and fully effective in accomplishing its intended purposes.

These, and other objects of the present invention, will become readily apparent upon further review of the following specifications and drawings.

BRIEF DESCRIPTION OF THE DRAWINGS

FIG. 4 is a top view of the hockey puck according to the present invention.

FIG. 5 is a cross-sectional view drawn along lines 5—5 of FIG. 4.

FIG. 6 is a cross-sectional view drawn along lines 6—6 of FIG. 4.

Similar reference characters denote corresponding features consistently throughout the attached drawings.

DETAILED DESCRIPTION OF THE PREFERRED EMBODIMENT

Figure 1:
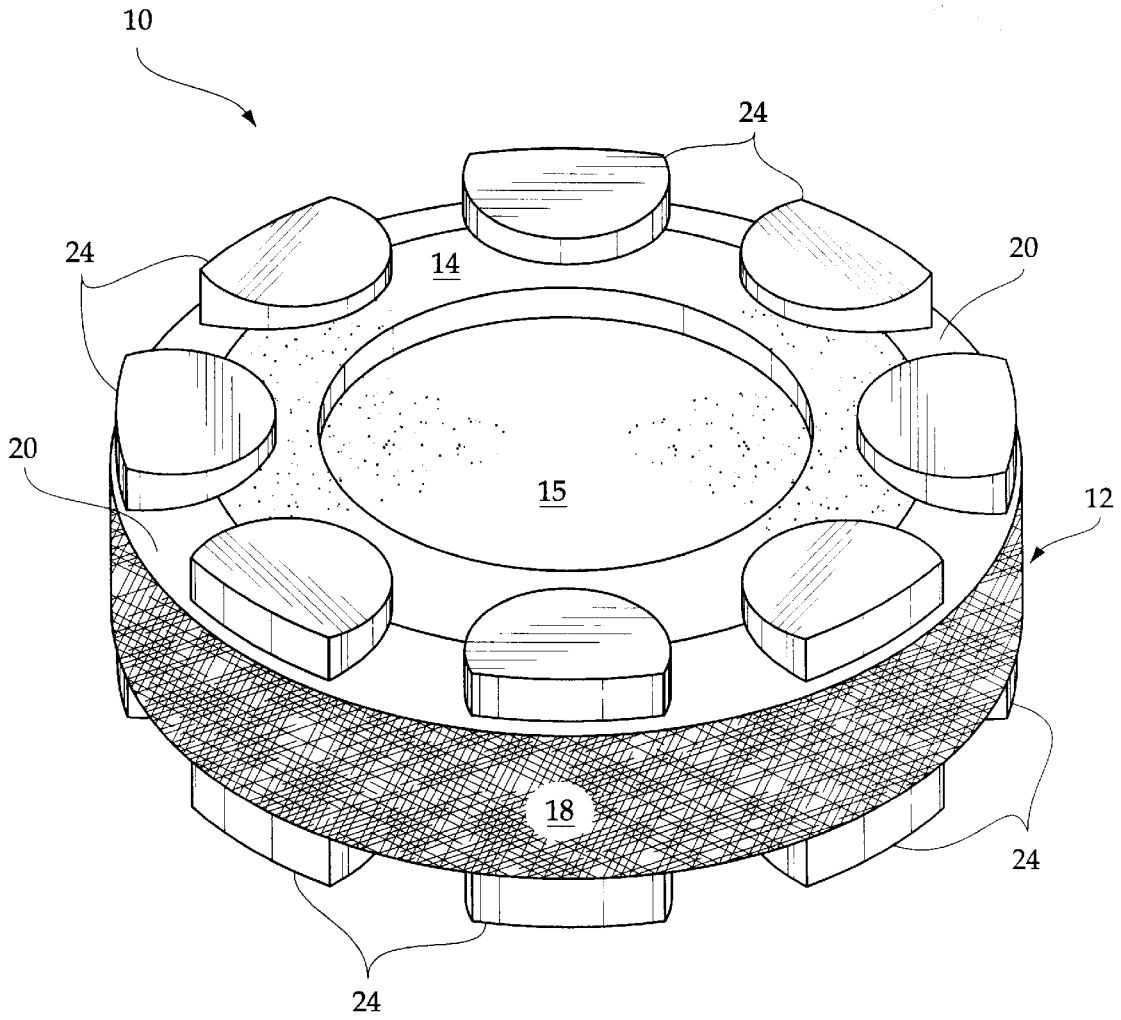
FIG. 1 is a perspective view of the hockey puck according to the present invention.

The preferred embodiment of the present invention, referenced herein as 10, comprises a substantially cylindrical body 12, fabricated from vulcanized rubber, and having top and bottom circular surfaces 14, 16, top and bottom recessed centers 15, 17, and an endless side 18. In the embodiment of the present invention, hockey puck 10, has a diameter of 3 inches, and an overall thickness of 1 inch. Between side 18 and top surface 14, an edge 20 is provided, which is beveled, sloping downward from top surface 14 to its intersection with side 18. An opposing second edge 22 separates bottom surface 16 in identical fashion from side 18. Edge 22 is also beveled, sloping upward from bottom surface 16 to its intersection with side member 18.

The hockey puck of present invention further comprises a plurality of runners, 24, fabricated from acetal plastic, which performs best on asphalt, concrete, hardtop, painted concrete, epoxy coated asphalt and concrete, tennis court surface, and other most common outdoor surfaces as well as indoor surfaces such as Sport Court. A custom-formulated derivative of the aforementioned material with lubricants added to it, can also be utilized to further lower the coefficient of friction on the chosen surface of play. Pucks of the present invention, game tested with acetal runners, performed most favorably on the widest range of play surfaces, in hot temperatures to below freezing. Due to the rapid growth of roller hockey, there exists such a variety of playing surfaces, that no lone material is ideal for all applications.

In the preferred embodiment of the invention, a total of 16 runners conform to the edges of cylindrical body 12, with eight runners placed therein, equally spaced about edge 20, and another eight runners placed therein, equally spaced about edge 22. Furthermore, the runners of the preferred embodiment have a partial-disk shaped exposed surface, where the diameter of the full disk is ¾ inch and the actual runner extends 9/16 inch inward from the outer perimeter of top and bottom surfaces 14, 16.

Figure 2A:
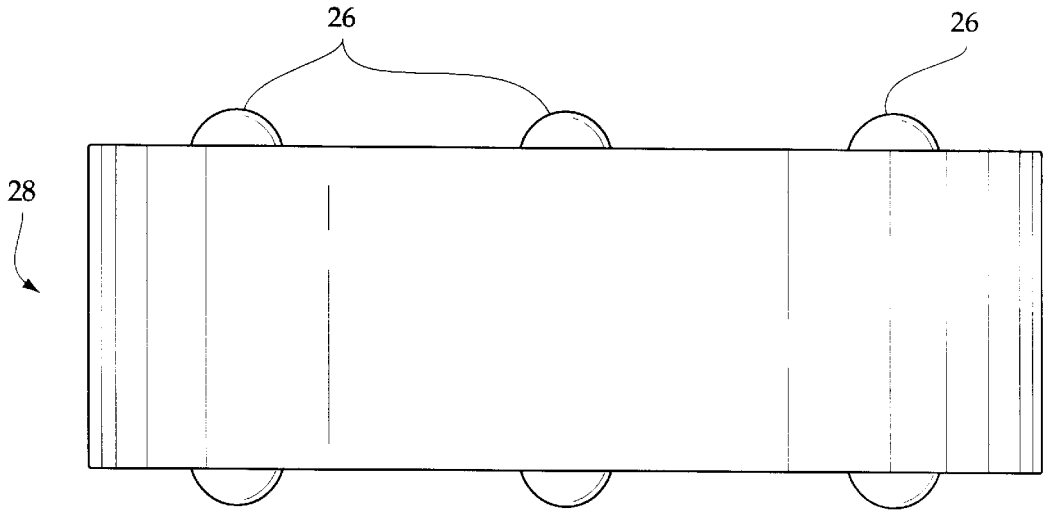
Fig. 2a (PRIOR ART)
FIG. 2A is a side view of a hockey puck of the prior art.
Figure 2B:
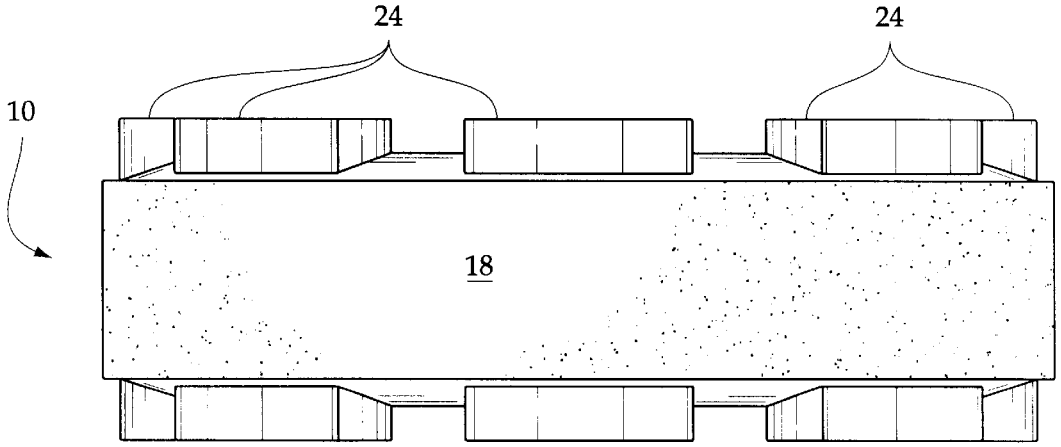
FIG. 2B is a side view of the hockey puck according to the present invention.

FIG. 2A is a side view of a puck design as generally known in prior art, puck 28, having hemispherical runners 26 projecting from puck body 29; FIG. 2B is a side view of the runner and puck design of the present invention, puck 10, having flat runners 24 projecting from rubber puck body 12.

Figure 3A:
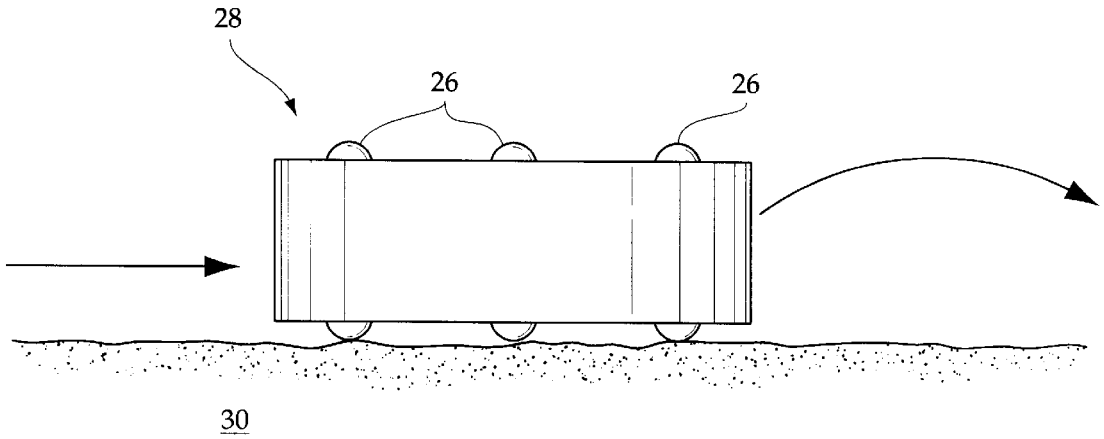
Fig. 3a (PRIOR ART)
FIG. 3A is a side view of the hockey puck of the prior art in a state of motion over an irregular playing surface.
Figure 3B:
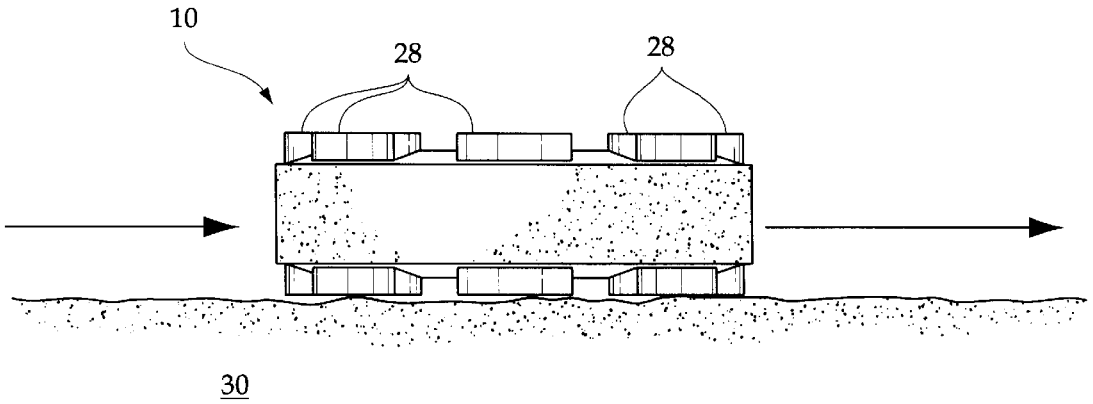
FIG. 3B is a comparative side view of the hockey puck according to the present invention in a state of motion over an irregular playing surface.

FIG. 3A is a side view of a puck design of the prior art in motion at horizontal over an irregular surface. FIG. 3B is a side view of the puck of the present invention in motion at horizontal over the same surface. In FIG. 3A, the small, rounded, heads of runners 26 lack the surface area to glide smoothly on less than smooth surface 30, causing puck to chatter as it glides, and potentially flip as illustrated by the accompanying jagged arrow and curved arrow respectively. Conversely, FIG. 3B illustrates how the larger, flat headed runners 24 on the present invention, are better suited not to catch or snag in the inconsistencies of surface 30, gliding smoothly as illustrated by the accompanying straight arrows.

Figure 3D:
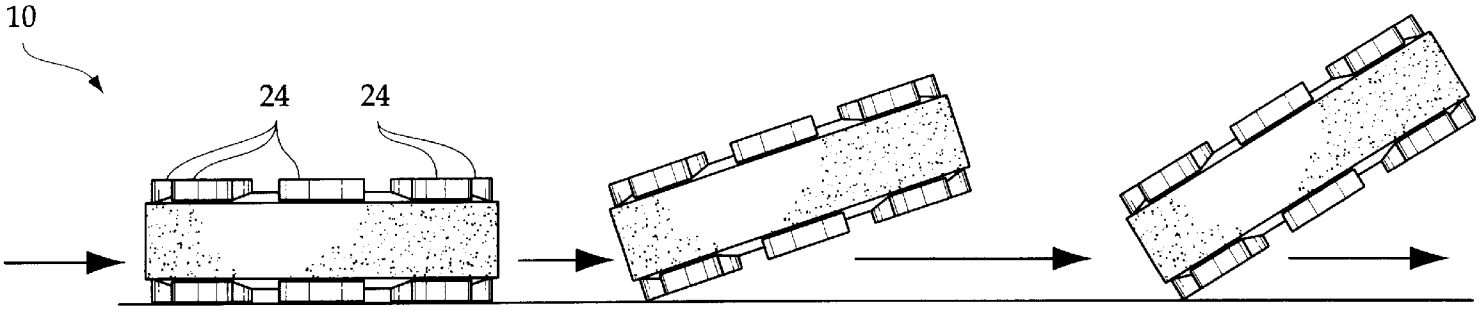
FIG. 3D is a comparative side view of the hockey puck according to the present invention on a relatively smooth surface being propelled from the horizontal position onto its peripheral edge.
Figure 3C:
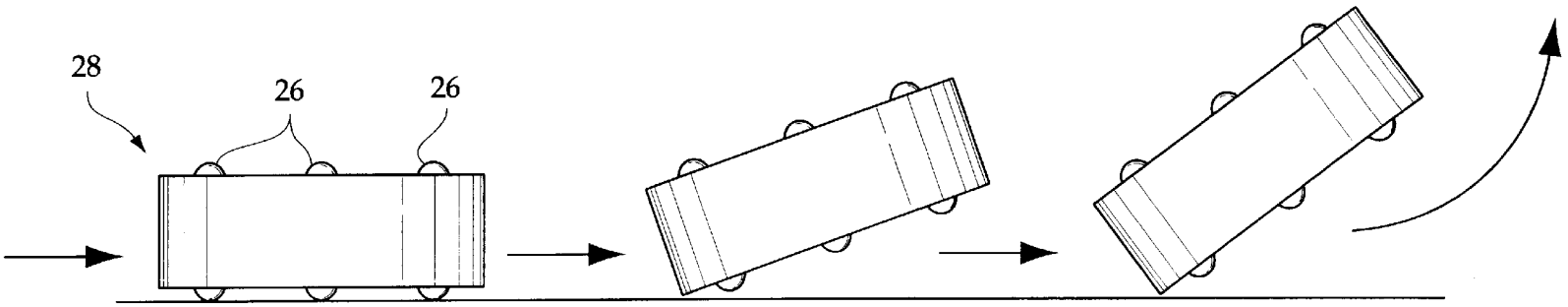
Fig. 3c (PRIOR ART)
FIG. 3C is a side view of the hockey puck of the prior art on a relatively smooth surface being propelled from the horizontal position onto its peripheral edge.

A contrast in such puck behavior is further illustrated on a smoother playing surface 31 in FIG. 3C and FIG. 3D. FIG. 3C shows puck 28 being propelled from the horizontal position, upward where runners 26 are no longer engaging the surface of play. As puck 28 moves, runners 26 are no longer in contact with the play surface, leaving the peripheral edge of the body of puck 28, which has a higher coefficient of friction than its runners, in contact with the surface of play. The resultant behavior of the increase in friction, causes puck 28 to hop or flip over, as indicated by the curved arrow. FIG. 3D shows puck 10 of the present invention being propelled in the same manner as the puck in FIG. 3C. Even with the change of angles from horizontal, the runners 24 remain in continuous contact, while in motion, with play surface 31. The runners of the present invention will engage the surface of play similarly, as the puck approaches angles of nearly 90 degrees from horizontal.

The resultant behavior is puck 10 maintaining continuous contact with the playing surface despite the rigors of play, as depicted by the straight arrows, as opposed to becoming airborne, as illustrated by the curved arrow of FIG. 3C.

FIG. 4 is a top view of the preferred embodiment of the present invention. A substantially cylindrical stem 23, integrally connects the runners along top surface 14 and the runners along bottom surface 16. This assembly is injection molded to form one solid mass to ultimately secure runners 24 to cylindrical body 12.

The annular formation of runners 24 along edge 20 accomplishes a symmetrical placement, so that each individual runner opposes one another at 180 degrees, to ultimately facilitate even puck maneuverability. The top and bottom sets of runners 24 are also aligned as shown in FIG. 1, to further balance the puck for dynamic equilibrium during play.

A cross sectional view of the present invention at line 5—5 in FIG. 4 is presented in FIG. 5. FIG. 6 is another cross-sectional view along line 6—6 of FIG. 4, and affords a side view of the runner-edge interfaces. In the preferred embodiment shown, cylindrical body 12 has a thickness of ¾ inch, while runners 24 each extend ⅛ inch from top and bottom surfaces 14, 16, for an overall puck thickness of 1 inch. Cylindrical body 12 also has a recessed center to enhance puck compression, that is 1.5 inches in diameter and is 0.15 inches deep, recess 15 within top surface 14, recess 17 within bottom surface 16. The outermost, thickest and exposed sides of runners 24 measure ¼ inch thick, and are recessed 1/16 inch from surface of side member 18. This structure ensures unrestricted contact between rubber side member 18 and players' stickblades during play.

It is to be understood that the present invention is not limited to the sole embodiment described above, but encompasses any and all embodiments within the scope of the following claims.

What is claimed is:

1. A hockey puck for street and court play comprising:

a substantially cylindrical puck body of vulcanized rubber construction, made from the same rubber compound, hardness (Durometer), and knurled outer side of a regulation ice hockey puck, said body including a top surface, a bottom surface and an endless side; and, a plurality of runners, each of said runners comprising a partial disc-shaped member engaging the periphery of said puck body on each said top surface and said bottom surface, each said partial disc shaped member having an outward facing side, slightly recessed from said endless side of said puck body, and an outer surface coplanar with an associated said top surface and an associated said bottom surface, said partial disc-shaped member extending beyond an associated said top surface and said bottom surface, and each said plurality of runners further having a substantially cylindrical connecting member, all of which connect and align said partial disc-shaped members to said puck body.

2. The hockey puck according to claim 1, further comprising:

an upper annular edge at the junction of said top surface and said endless side; and, a lower annular edge at the junction of said bottom surface and said endless side.

3. The hockey puck according to claim 2, said upper and lower annular edges being beveled to accommodate wearing properties of said runners.

4. The hockey puck according to claim 1, said runners spaced equidistantly about the periphery of said puck body whereby even puck maneuverability and balance for dynamic equilibrium in play is achieved.

5. The hockey puck according to claim 1, said runners fabricated from acetal plastic, or other custom-formulated derivative thereof, to minimize the frictional resistance between said partial disc-shaped exposed surfaces and the play surface, as well as to endure impact at high velocities under a variety of climatic conditions.

* * * * *